US005154666A

United States Patent [19]

Wapner

[11] Patent Number: 5,154,666

[45] Date of Patent: Oct. 13, 1992

[54] AIR EXCHANGE SYSTEM FOR USE IN MULTI-STORY BUILDING

[76] Inventor: Daniel Wapner, 525 Park Ave. No. 5B, New York, N.Y. 10021

[21] Appl. No.: 798,356

[22] Filed: Nov. 21, 1991

Related U.S. Application Data

[63] Continuation of Ser. No. 583,908, Sep. 17, 1990, abandoned.

[51] Int. Cl.[5] ..... F24F 7/007; F24F 13/04; F24F 11/02

[52] U.S. Cl. ..... 454/290; 454/265; 454/257; 454/258; 454/292

[58] Field of Search ..... 98/33.1, 29, 31, 31.6, 98/34.6, 39.1, 40.06; 454/186, 265, 257, 238, 290, 292

[56] References Cited

U.S. PATENT DOCUMENTS

| | | | |
|---|---|---|---|
| 982,721 | 1/1911 | Hodges | 98/31 |
| 1,443,986 | 2/1923 | Forcier | 98/31 |
| 2,055,988 | 9/1936 | Stacey, Jr. et al. . | |
| 2,295,251 | 9/1942 | Baker | 98/39.1 |
| 2,729,429 | 1/1956 | Goemann . | |
| 2,877,990 | 3/1959 | Goemann . | |
| 2,971,747 | 2/1961 | Young . | |
| 3,356,134 | 12/1967 | Sawyer | 98/31 |
| 3,516,347 | 6/1970 | May | 98/31 |
| 3,687,055 | 8/1972 | Dean, Jr. et al. | 98/40.06 |
| 4,034,526 | 7/1977 | Deslaugiers | 98/31 |
| 4,786,300 | 11/1988 | Uematsu et al. . | |
| 4,860,642 | 8/1989 | Nussbaum | 98/34.6 |

FOREIGN PATENT DOCUMENTS

| | | | |
|---|---|---|---|
| 0064942 | 6/1978 | Japan | 98/29 |
| 0134430 | 6/1987 | Japan | 98/29 |

*Primary Examiner*—Albert J. Makay
*Assistant Examiner*—William C. Doerrler
*Attorney, Agent, or Firm*—Peter J. Phillips

[57] ABSTRACT

An air exchange system is disclosed for use in a building having a plurality of stories each having a base floor, finished floor, finished ceiling and rough ceiling. The system comprises a plurality of main distribution ducts each adapted to be located in the space defined between the finished ceiling of a lower story and the finished floor of an upper story lying immediately above the lower story. The main ducts are located on alternate floors and adapted to supply sufficient air for the two adjacent floors. Each of the main ducts are provided with at least one upper duct which communicates with an upper story through the base floor and at least one lower duct which communicates with a lower story through the rough ceiling thereof. A variable air volume control unit is connected to each upper and lower duct controlling the volume of conditioned air entering a story of the building in order to control the temperature within the user space therein. A fire separator element is provided in the variable air volume control for the upper story to close the variable air volume valve to prevent fire, smoke and debris in one floor from entering an adjacent floor.

15 Claims, 3 Drawing Sheets

AIR EXCHANGE SYSTEM FOR USE IN MULTI-STORY BUILDING

This is a continuation of application Ser. No. 07/583,908, filed Sep. 17, 1990, now abandoned.

BACKGROUND OF THE INVENTION

The present invention relates to an air exchange system for use in multi-story buildings which, in particular, reduces the average floor to floor height required in multi-story buildings.

A typical steel frame multi-story office or residential or mixed use) building is built with a 12'6" to 13' floor to floor height. This allows for an 8'6" to 9' ceiling height measured from ceiling to finished floor (not the top of the access floor.) Approximately 4' is reserved for ceiling space and included therein, for example, are concrete/metal decks, steel framing, fireproofing, air distribution systems, lighting, sprinkler systems, and other ceiling construction. A large portion of this 4' space is needed for accommodating the air distribution system for air conditioning and/or heating the occupied space.

In addition to the ceiling space required between floors, many office buildings that are built today also require access flooring to be built throughout the occupied space in order to facilitate the installation and replacement of wiring which is required to operate and interact with computers, telephones, communication systems, typewriters, etc. A typical access floor for normal office use is 6". Many special applications such as computer rooms, trading floors, etc. require floors as high as 24".

When a 6" access flooring is included as a tenant amenity, the available ceiling height decreases to approximately 8' to 8'6". In order to achieve a 8'6" ceiling with a raised floor and a 12'6" floor to floor height, more design and construction effort is required to make the ceiling less deep. Consequently, the construction is more costly due to the increase in materials, such as increased curtainwall, increased material for longer elevator travel and more structural steel. The curtainwall, for example, of a new building could be as high as $75.00/sq. ft. or $38.00 a foot of perimeter per floor of building to raise the floor-to-floor height by 6".

In a typical 50 story office building, this cost would normally fall in the range of $1,500,000 or approximately $1.00/sq.ft. of floor area. In addition to the increased cost, many zoning laws restrict building height such that if the floor to floor height is increased the developer will lose available floor area.

In one attempted solution to this problem, an access floor manufacturer has developed a system which distributes air under the floor. In this system, air is pumped under low pressure under the floor using a typical air conditioning ducts. The air in the ducts enters the office areas through grilles cut in the access floor. These grilles are spaced according to the tenant's individual space plan. Since the air is under low pressure, a fan located in the grill is used to suck the air out of the floor space and into the office space. The fan is thermostatically controlled to control the space temperature. The air conditioning unit is located within the core of the building near the elevators. Air from the unit must then cross under the corridors usually placed around the core by space planners. However, the corridor area is also used to run the wiring systems and is therefore most likely to require service. Servicing this area requires removal of the panels located along the floor and usually near the source of the incoming air. Removal of the panels causes the remaining floor to be deprived of air conditioning or heating for extended periods of time. Furthermore, improper replacement of the panels will result in an air leak. For these reasons, this system has had limited success.

As noted by the foregoing, the prior art has failed to provide an air conditioning and distributing system for use in a multi-story building which minimizes the floor to floor height needed to construct the building while providing available ceiling height of at least 8', for example, in the occupied user space.

SUMMARY OF THE INVENTION

Accordingly, it is an object of the present invention to provide an air conditioning and distribution system for use in a multi-story building which minimizes the average floor to floor height needed to construct a building while providing available ceiling height of 8' or more, for example, in the occupied space.

According to one form of the present invention, an air exchange system is provided for a building having a plurality of stories each having a base floor, finished floor, finished ceiling and rough ceiling, thereby defining user space between the finished floor and finished ceiling. The air exchange system comprises a plurality of air distribution duct means each located between the finished ceiling of one lower story and the finished floor of another upper story lying immediately above the one lower story. The air distribution means are located on alternate floors and adapted to supply sufficient conditioned air for the user space in two adjacent floors. Each of the air distribution duct means comprises means for delivering conditioned air into the one lower story through the finished ceiling and another upper story through the finished floor.

DETAILED DESCRIPTION OF THE PREFERRED EMBODIMENT

The present invention will now be described in detail with reference to the drawings.

Figure 1:
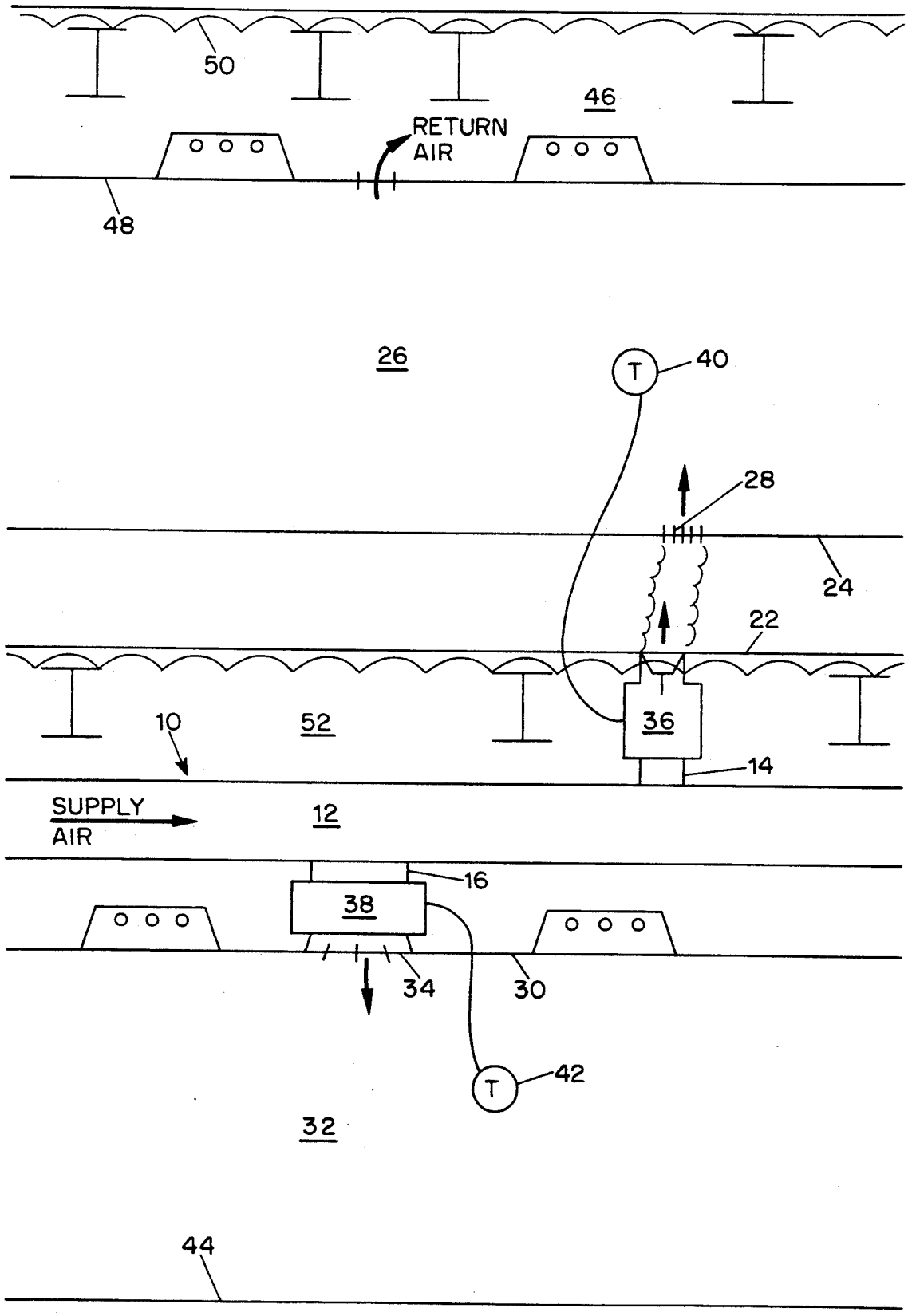
FIG. 1 is a side cross-sectional view of an air exchange system according to the present invention located between two adjacent floors.

Referring to FIG. 1, there is shown a cross sectional view of the air exchange system 10 according to the present invention. The system includes a generally horizontal main distribution duct 12 through which conditioned air is brought to the floors. Conditioned air may be supplied to the main distribution duct 12 by an air exchange unit (not shown) through the building core (not shown). An upper duct 14 and a lower duct 16 are tapped off and in communication with the main distribution duct 12.

The upper duct 14 passes through an opening in the cement deck 22 and the access flooring 24 located below the upper story office space 26 so that conditioned air can enter the office space 26 of the upper story through a floor grill 28 in finished floor 24. Likewise, conditioned air from the main distribution duct 12 can enter the lower story office space 32 of the lower adjacent floor by passing through the lower duct 16 and the ceiling grill 34. The floor grill 28 and ceiling grill 34 can, of course, be located elsewhere, such as on the walls of the respective office spaces. If distribution grill 28 is located on a wall of adjacent space, the configuration may be that shown in FIG. 3 to be described below.

The upper and lower ducts 14 and 18 include variable air volume controls 36 and 38, respectively, to control the temperature in the office spaces 26 and 32. The variable air volume controls 36 and 38 are controlled by thermostats 40 and 42, respectively.

In the preferred embodiment, the main distribution duct is built larger than a conventionally sized duct for a single floor in order to supply sufficient air to two adjacent floors.

As shown in FIG. 1, the access floor 44 located below the office space 32 is not as high above its respective base floor (not shown) as the access floor 24 is above base floor 22 because it need not contain any ducts for air distribution. Similarly, the access ceiling space 46 above office space 26 between finished ceiling 48 and rough ceiling 50 need not be as high as the access ceiling space 52 because it need not contain any main ducts for air distribution. However, ducts may be provided in access ceiling space 46 for collecting return air, as shown. The distance between the finished ceiling upward to the finished floor for the alternate floors which do not contain the air ducts can be much less than the distance between the finished ceiling upward to the finished floor for the other alternate floors which do contain the main air and other ducts. The overall average floor-to-floor height of a multi-story building can thereby be significantly reduced, because air conditioning units need be located only on alternate floors.

Figure 2:
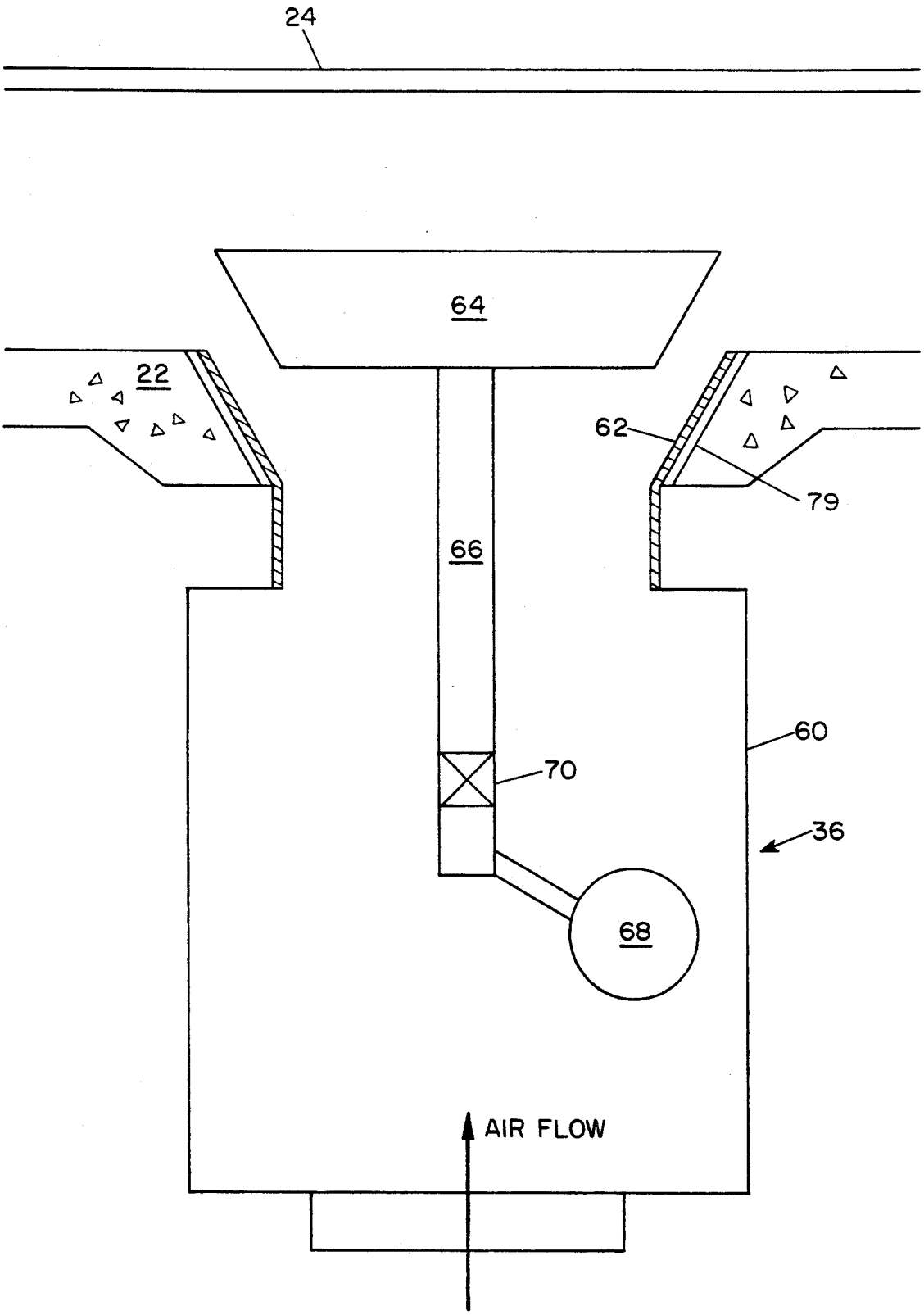
FIG. 2 is a side view showing, in closer detail, a variable air volume control including a fire separator device which can be used in the air exchange system according to the present invention.

Turning now to FIG. 2, the variable air volume control 36 will be described in greater detail. The variable air volume control 36 comprises a valve box 60, which defines, in its upper region, a valve seat 62, annular in configuration. Valve piston member 64, having a frustoconical shape, is configured and sized to fit snugly in valve seat 62 to thereby close the valve. A shaft 66 is mounted at its upper end to the underside of valve piston member 64, and at its lower end to pneumatic motor 68. Motor 68 is connected to and responsive to the thermostat 40 located in the upper story user space 26. Depending on the sensed temperature, the motor 68 will raise or lower valve piston member 64 to thereby control the volume of conditioned air delivered to the user space 26. A fusible heat responsive link 70 is provided in shaft 66, which melts in response to an abnormal level of heat indicating a fire or the like, to thereby disconnect the shaft 66 from motor 58 and allow the piston member 64 to drop into valve seat 62 by force of gravity and thereby serve as a fire separator element. A similar arrangement can be provided for the variable air volume control 38, except for the fusible link 70.

The valve seat 62, valve piston member 64 and shaft 66 are of course made of non-combustible and fire proof or fire resistant material.

The variable air volume control 34, particularly the annular seat 62 portion, fits into an opening in the base floor 22 which is annular in shape. The annular opening in the base floor 22 can be achieved by either locating preset inserts 79 in the slab at predetermined locations either in a grid or according to a space plan before the cement floor is poured, or by cutting holes in the floor 22 after the cement is poured.

Figure 3A:
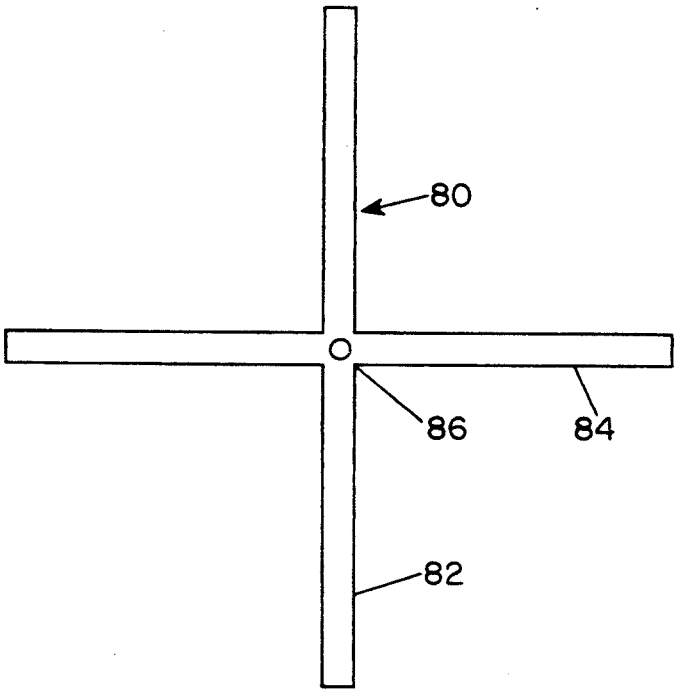
FIG. 3A is a top plan view of a room divider partition for use in an upper story for delivering and distributing conditioned air.
Figure 3B:
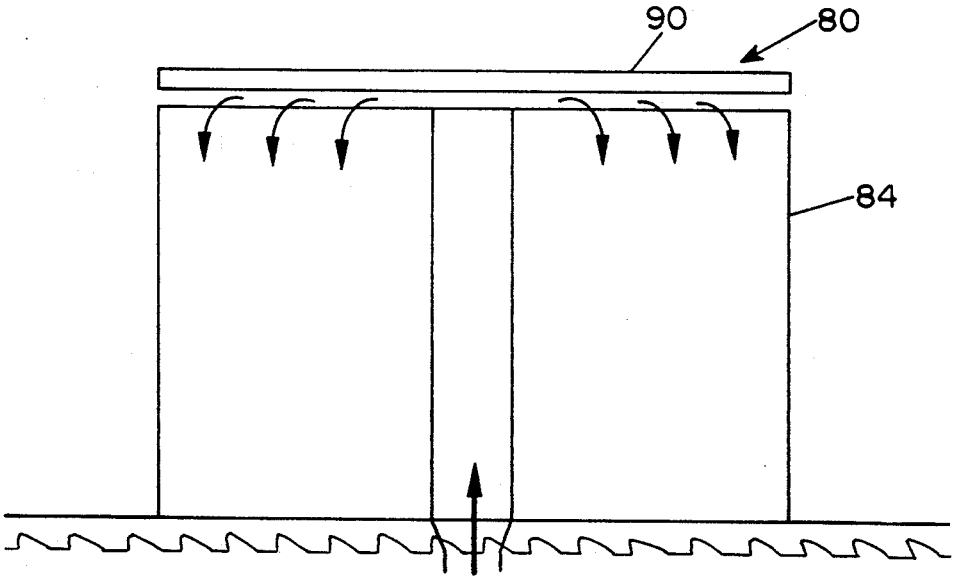
FIG. 3B is a side elevational view of the room divider partition o FIG. 3A.
Figure 3C:
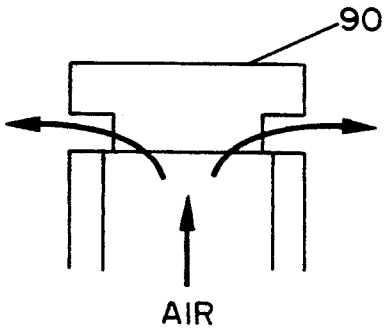
FIG. 3C is a side elevational view in cross-section, of the partition and cap base of the partition.

A partition arrangement for distributing conditioned air in an upper story is shown in FIGS. 3A, 3B and 3C. The partition 80 comprises two walls 82 and 84 which are about 3'0 to 7' in height and intersect about midway along their length to divide part of the user space into four quadrants. The partitions can define quadrants for a four person work station in an office space environment. The walls of the partition can be partially or totally hollow and the hollow portion communicates at its lower end with duct 14. A top cap 90 is provided which covers the entire partition structure and defines therein a horizontal channel in communication with the hollow portion. Perforations are formed along the underside of the top cap 90, as shown in FIG. 3C, to provide conditioned air to the four quadrant areas.

In the preferred embodiment, the air exchange system is used to provide cool conditioned air for an office building. However, the disclosed and other particular embodiments can be constructed and used for providing heated air.

While the preferred embodiment has been described in conjunction with an office building, it of course may be used for a residential or mixed use multi-story building.

It has now been shown that conditioned air is provided and distributed to the floors of an office building in a less expensive and more efficient manner than provided in the prior art.

While one preferred embodiment of the present invention has been shown and described, it will be apparent that many modifications and variations could be effected by one skilled in the art without departing from the spirit or scope of the novel concept of the invention, which should be determined by the appended claims.

What is claimed is:

1. An air exchange system for a building having a plurality of stories each having a base floor, finished floor, finished ceiling and rough ceiling, thereby defining user space between the finished floor and finished ceiling, comprising a plurality of air distribution duct means, each located between the finished ceiling of one lower story and the finished floor of another upper story lying immediately above the lower story, each of said distribution duct means being located only on alternate floors and having ducts large enough to supply sufficient conditioned air for the user space in two adjacent floors, each of said air distribution duct means comprising means for delivering conditioned air into the lower story through the finished ceiling and the upper story through the finished floor, and wherein the distance between the finished ceiling to finished floor on alternate floors where duct means are located is substantially less than the corresponding distance on other floors where duct means are not located.

2. The air exchange system according to claim 1, wherein each air distribution duct means comprises a generally horizontal main duct, at least one upper duct in communication with said main duct which passes through an opening defined in a deck floor between the base floor and rough ceiling for providing conditioned air to the upper story through the finished floor of said upper story, and at least one lower duct in communication with said main duct for providing conditioned air to the lower story through the finished ceiling of said lower story.

3. The air exchange system according to claim 2, further comprising a fire separator means for closing the upper duct in response to detecting an abnormal level of heat.

4. The air exchange system according to claim further comprising at least one variable air volume control means for adjusting the volume of conditioned air provided to at least one of said stories.

5. The air exchange system according to claim 4, further comprising temperature responsive means for sensing the temperature in the one story, and wherein the variable air volume control means comprises means for adjusting the volume of conditioned air in response to said temperature responsive means.

6. The air exchange system according to claim 4, wherein at least two variable air volume control means are provided, at least one for the lower story and at least one for the upper story.

7. The air exchange system according to claim 4, wherein each variable air volume control means comprises a valve box having a valve seat, a valve piston member, and means for moving said valve piston member between a closed position wherein said valve piston member rests in said valve seat, and an open position wherein said valve piston member is displaced from said valve seat to provide a opening for the passage of conditioned air.

8. The air exchange system according to claim 7, wherein the variable air volume control means further includes a shaft mounted to said valve piston member, and wherein the means for moving said valve piston member comprises motor means attached to said shaft.

9. The air exchange system according to claim 8 wherein the variable air volume control means further comprises a fusible link means for automatically causing said valve piston member to move to a closed position in response to an abnormal level of heat.

10. The air exchange system according to claim 1, further comprising at least one room divider partition comprising at least one wall defining a hollow portion therein, said hollow portion being in communication with the means for delivering air into the upper story, said partition further comprising means for directing conditioned air in the user space of the upper story.

11. The air exchange system according to claim 10, wherein the room divider partition comprises two walls, said two walls intersecting at about midway along each wall to define four quadrants in said user space, said partition further comprising an air deflection means at the top of said walls for directing conditioned air into said quadrants.

12. The air exchange system according to claim 11, wherein the air deflection means comprises a partition cap extending along the length of the top of both walls, said cap having a perforated base for delivering conditioned air from said channel into said quadrants.

13. The air exchange system according to claim 1, wherein said main distribution duct is located between the finished ceiling and rough ceiling of said one lower story.

14. The air exchange system according to claim 1, wherein said air distribution duct means provides cool conditioned air.

15. An air exchange system for a building having a plurality of stories each having a base floor, finished floor, finished ceiling and rough ceiling, thereby defining user space between the finished floor and finished ceiling, comprising a plurality of air distribution duct means, each located between the finished ceiling of one lower story and the finished floor of another upper story lying immediately above the lower story, each of said distribution duct means being located only on alternate floors and having ducts large enough to supply sufficient conditioned air for the user space in two adjacent floors, each of said air distribution duct means comprising means for delivering conditioned air into the lower story through the finished ceiling and the upper story through the finished floor, and wherein the distance between the finished ceiling to finished floor on alternate floors where duct means are located is substantially less than the corresponding distance on other floors where duct means are not located, and including at least one variable air volume control means for adjusting the volume of conditioned air provided to at least one of said stories, said variable air volume control means comprising a valve box having a seat, a valve piston member and means for moving said valve piston member between a closed position wherein said valve piston member rests in said valve seat, and an open position wherein said valve piston member is displaced from said valve seat to provide an opening for the passage of conditioned air, and further including fusible link means for automatically causing said valve piston member to move to a closed position in response to an abnormal heat level.

* * * * *